US011536078B2

(12) United States Patent
Dreyer

(10) Patent No.: US 11,536,078 B2
(45) **Date of Patent: *Dec. 27, 2022**

(54) CONFIGURATION OF ENTRANCE SYSTEMS HAVING ONE OR MORE MOVABLE DOOR MEMBERS

(71) Applicant: Assa Abloy Entrance Systems AB, Landskrona (SE)

(72) Inventor: Roger Dreyer, Bjarred (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 122 days.

This patent is subject to a terminal disclaimer.

(21) Appl. No.: 17/058,039

(22) PCT Filed: Jun. 12, 2019

(86) PCT No.: PCT/EP2019/065274

§ 371 (c)(1),
(2) Date: Nov. 23, 2020

(87) PCT Pub. No.: WO2019/238718

PCT Pub. Date: Dec. 19, 2019

(65) Prior Publication Data

US 2021/0222479 A1 Jul. 22, 2021

(30) Foreign Application Priority Data

Jun. 15, 2018 (SE) ..... 1830193-7

(51) Int. Cl.
*G08B 13/08* (2006.01)
*E05F 15/73* (2015.01)
*E05F 15/603* (2015.01)

(52) U.S. Cl.
CPC ..... *E05F 15/73* (2015.01); *E05F 15/603* (2015.01); *E05F 2015/767* (2015.01);
(Continued)

(58) Field of Classification Search
CPC ..... E05F 2015/483; E05F 5/06; E05F 5/00; E05F 15/43; E05F 15/40; E05F 15/73;
(Continued)

(56) References Cited

U.S. PATENT DOCUMENTS 6,326,754 B1 12/2001 Mullet et al.
7,525,412 B2 4/2009 Jankovsky
(Continued)

FOREIGN PATENT DOCUMENTS

GB 2409911 7/2005
GB 2455412 6/2009
(Continued)

OTHER PUBLICATIONS

International Search Report and Written Opinion in PCT/EP2019/065274, dated Sep. 27, 2019.
(Continued)

*Primary Examiner* — Chi Q Nguyen
(74) *Attorney, Agent, or Firm* — Wissing Miller LLP

(57) ABSTRACT

An entrance system is disclosed which has a movable door member having a door leaf with a first vertical edge and a second vertical edge. A sensor unit monitors a zone at or near the door leaf for presence or activity of a person or object, and captures an image of an external object at the first vertical edge of the door leaf, and processing the captured image to identify an optical code and recognize a learning mode trigger instruction encoded therein. Triggered by the recognizing of the learning mode trigger instruction, a learning mode of the sensor unit is automatically entered into, in which a distance between the sensor unit and the external object at the first vertical edge is automatically measured and a field width parameter value of the sensor unit is set based on the measured distance.

20 Claims, 9 Drawing Sheets

(52) U.S. Cl.
CPC ..... *E05Y 2201/434* (2013.01); *E05Y 2400/44* (2013.01); *E05Y 2400/456* (2013.01); *E05Y 2800/00* (2013.01); *E05Y 2900/132* (2013.01)

(58) Field of Classification Search
CPC ..... E05F 15/60; E05F 15/70; E05F 15/632; E05F 2017/005; E05Y 2400/504; E05Y 2400/458; E05Y 2400/502; E05Y 2800/404; E05Y 2400/852; E05Y 2400/508; E05Y 2900/132; E05Y 2400/50; E05Y 2201/254; E05Y 2400/21; E05Y 2201/25; E05Y 2201/256; E05Y 2201/21; E05Y 2400/532; E05Y 2900/531
USPC ..... 49/31, 26, 28, 36; 250/221; 701/49, 701/301, 45, 36, 26; 340/901, 540; 318/480, 445
See application file for complete search history.

(56) References Cited

U.S. PATENT DOCUMENTS

| | | | | |
|---|---|---|---|---|
| 7,548,557 | B2 | 6/2009 | Hom | |
| 9,995,076 | B1 * | 6/2018 | Hoffberg | E05F 3/10 |
| 11,168,508 | B2 * | 11/2021 | Dreyer | E05F 15/40 |
| 11,248,410 | B2 * | 2/2022 | Dreyer | E05F 15/603 |
| 2002/0118113 | A1 * | 8/2002 | Oku | G08B 13/181 340/540 |
| 2003/0193304 | A1 | 10/2003 | Fitzgibbon | |
| 2004/0210327 | A1 | 10/2004 | Robb | |
| 2006/0160484 | A1 * | 7/2006 | Falk | F24F 9/00 454/195 |
| 2006/0186991 | A1 | 8/2006 | Jankovsky et al. | |
| 2006/0244403 | A1 * | 11/2006 | Christensson | E05F 15/73 318/280 |
| 2008/0016771 | A1 * | 1/2008 | Marchetto | E05F 15/40 340/13.24 |
| 2008/0022596 | A1 * | 1/2008 | Boerger | E06B 9/82 49/31 |
| 2008/0052996 | A1 * | 3/2008 | Sugiura | E05F 15/42 49/27 |
| 2012/0174483 | A1 * | 7/2012 | Harlow | E05F 15/74 49/506 |
| 2013/0127590 | A1 * | 5/2013 | Braverman | E05F 15/79 340/5.7 |
| 2013/0145692 | A1 * | 6/2013 | Laird | E05F 15/73 49/31 |
| 2013/0186001 | A1 * | 7/2013 | Cui | E05F 15/77 49/31 |
| 2015/0262438 | A1 | 9/2015 | Zasowski et al. | |

FOREIGN PATENT DOCUMENTS

| | | |
|---|---|---|
| WO | 2006000235 | 1/2006 |
| WO | 2019043084 | 3/2019 |

OTHER PUBLICATIONS

Swedish Search Report in Swedish Pat. Appl. No. 1830193-7, dated Jan. 17, 2019.

* cited by examiner

Configuring an entrance system 1 by using a sensor unit 300/S1:

Configuring an entrance system 1 by using a sensor unit 300/S1:

Configuring an entrance system 1 by using a sensor unit 300/S1:

Configuring an entrance system 1 by using a sensor unit 300/S1:

CONFIGURATION OF ENTRANCE SYSTEMS HAVING ONE OR MORE MOVABLE DOOR MEMBERS

This application is a 371 of PCT/EP2019/065274 filed on Jun. 12, 2019, published on Dec. 19, 2019 under publication number WO 2019/238718, which claims priority benefits from Swedish Patent Application No. 1830193-7, filed on Jun. 15, 2018, the disclosure of which is incorporated herein by reference.

TECHNICAL FIELD

The present invention generally relates to configuration of entrance systems having a movable door member (or more than one movable door member) and an automatic door operator for causing movement of the movable door member. More specifically, the present invention relates to such entrance systems which furthermore have a sensor unit (or more than one sensor unit) for monitoring a zone near or at a door leaf of the door member for presence or activity of a person or object. The present invention also relates to an associated configuration method for an entrance system.

BACKGROUND

Entrance systems having automatic door operators are frequently used for providing automatic opening and closing of one or more movable door members in order to facilitate entrance and exit to buildings, rooms and other areas. The door members may for instance be swing doors, sliding door or revolving doors.

Since entrance systems having automatic door operators are typically used in public areas, user convenience is of course important. The entrance systems need to remain long-term operational without malfunctions even during periods of heavy traffic by persons or objects passing through the entrance systems. At the same time, safety is crucial in order to avoid hazardous situations where a present, approaching or departing person or object (including but not limited to animals or articles brought by the person) may be hit or jammed by any of the movable door members.

Entrance systems are therefore typically equipped with a control arrangement including a controller and one or more sensor units, where each sensor unit is connected to the controller and is arranged to monitor a respective zone at the entrance system for presence or activity of a person or object. In order to provide user convenience and long-term operational stability and at the same time prevent injuries or damages to present, approaching or departing persons or objects, it is of paramount importance that the sensor units provide accurate output signals to the controller. The controller, which may be part of the automatic door operator or a separate device, controls the operation of the automatic door operator and therefore the automatic opening and closing of the movable door members based on the output signals from the sensor units. If a sensor unit fails to provide an output signal to the controller when a person or object should have been detected, there is an apparent risk for injuries or damages. Conversely, if a sensor unit provides "false alarm" output signals to the controller in situations where rightfully nothing should have been detected, then there is an apparent risk that the controller will command the automatic door operator to stop or block the automatic opening or closing of the movable door members and hence cause user annoyance or dissatisfaction.

The sensor units typically comprise active/passive infrared sensors/detectors, radar/microwave sensors/detectors, image-based sensors/detectors, or combinations thereof.

In order to ensure reliable operation of the sensor units, they need to be configured in the entrance system. Aspects that may need configuration may, for instance and without limitation, include sensor angle, dimensions of the zone/volume to monitor and/or of other parts of the entrance system, ambient light conditions, and stationary sources of interference such as the presence of reflective surfaces, door handles, etc, in the local environment. Since many of these aspects are dependent on site-specific circumstances, the sensor units cannot normally be preconfigured in factory but have to be configured on site.

Sensor units in entrance systems may be configured on site by invoking a learning mode. In the learning mode, the automatic door operator may be controlled to perform a learn cycle during which the movable door members of the entrance system are operated according to a predefined program or manually by the person making the configuration on site. The sensor unit may register certain aspects during the learn cycle and automatically configure itself as regards these aspects. However, the way to invoke and perform the learning mode involves several manual steps. This will now be explained in some more detail with reference to an exemplifying entrance system 1 in FIG. 1.

FIG. 1 is a schematic front view of a swing door-based entrance system 1 according to the prior art. The entrance system 1 comprises a single door member in the form of a swing door 10 having a door leaf 12. The swing door 10 has a first vertical edge 14L (also known as leading door edge), as well as a second vertical edge 14S (also known as secondary closing edge) on the opposite side of the door leaf 12.

The swing door 10 is pivotally supported at the second vertical edge 14S by hinges 16 for allowing opening of the swing door 10 from a closed position to an open position, as well as for allowing closing of the swing door 10 from the open position to the closed position. The swing door 10 is hence supported by a door frame 11 for pivotal motion around a rotational axis 18 which is coincident with the hinges 16. The entrance system 1 comprises a motorized automatic door operator 30 capable of causing opening of the swing door 10. A linkage mechanism 40 connects the automatic door operator 30 to the swing door 10. The door operator 30 may be arranged in conjunction with the door frame 11 and is typically a concealed overhead installation in or at the door frame 11 (hence, the linkage mechanism 40 and automatic door operator 30 are normally not as visible to the naked eye as appears to be the case in FIG. 1).

The automatic door operator 30 may be triggered by sensor equipment in the entrance system 1. Such sensor equipment may include activity sensors (e.g. IR or radar based sensors) which are adapted to detect an approaching user and accordingly trigger the automatic door operator 30 to open the door member 10. Alternatively, the automatic door operator 30 may be triggered by a user actuating a door-open push button 15, or similar actuator. The entrance system 1 will typically also allow the user to open or close the swing door 10 by pulling or pushing a door handle 13 by manual force, i.e. without using the motorized automatic door operator 30.

The automatic door operator 30 may provide automatic opening of the swing door 10 in various possible applications. Such applications include, for instance, facilitating a disabled person's access to his or her private home, providing access through entrance ports or internal doors at healthcare buildings, office premises, industries or retail stores, providing comfort access to hotel rooms, etc. The automatic door operator 30 may also be used in fire door applications.

To avoid dangerous situations where a present, approaching or departing person or object (including but not limited to pets or articles brought by the person) might be hit or jammed by the swing door 10, a sensor unit S1 is provided in the entrance system 1. The sensor unit S1 is mounted at an appropriate position on the surface of the door leaf 12. As can be seen in FIG. 1, such a position is often at an uppermost part of the door leaf 12 near the second door edge 14S.

The purpose of the sensor unit S1 is to monitor a zone, or volume, at or near the door leaf 12 for presence or activity of a person or object. If a person or object is detected in the monitored zone, the automatic door operator 30 shall not be allowed to move the swing door 10 in a direction in which the swing door 10 may hit or jam that person or object. Hence, the detection by the sensor unit S1 may thus prevent the automatic door operator 30 from operating the swing door 10, or stop an ongoing operation of the swing door 10.

In order for the monitoring of the sensor unit S1 to be safe and reliable, the monitored zone at or near the door leaf 12 needs to be defined by various parameters. One such parameter is field width, indicated as FW in FIG. 1 and defining a distance from the position of the sensor unit S1 on the door leaf 12 to the leading vertical edge 14L. Another parameter is field height, indicated as FH in FIG. 1 and defining a distance from the position of the sensor unit S1 on the door leaf 12 to the floor level FL.

Other parameters define a default representation of the monitored zone in the absence of a person or object, i.e. how the monitored zone looks like from a stationary point of view when there is no alerting presence in the zone.

To configure the sensor unit S1 and set the above and other parameters to suitable values by way of a learning mode, the following is typically required.

First, a technician has to cause a power-on reset of the automatic door operator 30. This will involve removing a hood or other part from the concealed overhead installation covering the automatic door operator 30, and then either unplugging and restoring a power cord, or switching a power button off and on. The power-on reset of the automatic door operator 30 will cause the sensor unit S1 in the entrance system 1 to either reset itself too, or at least (if the sensor unit S1 has its own power source) become notified by the automatic door operator 30 about the power-on reset.

In order not to cause entry into learning mode in situations where the power-on reset was unintentionally caused by, for instance, a power glitch or temporary mains power shortage, a second manual intervention with the sensor unit S1 is required. This will typically involve the technician covering the sensor unit with his bare hands for a number of seconds, or alternatively removing a housing of the sensor unit S1 and pressing a certain button.

Only then will the sensor unit S1 enter into learning mode. To define the field width FW, the technician may hold his hand or a separate object at the leading vertical edge 14L for a certain time; this will allow the sensor unit S1 to measure a distance to the technician's hand or separate object, and from that determine an appropriate value of the field width FW. To define the default representation of the monitored zone in the absence of a person or object, the technician will actuate the push button 15 to cause a full opening and subsequent closing cycle for the swing door 10.

The present inventor has realized that the prior art approach has several disadvantages.

First, it is labour intense since many steps of manual intervention are required by the technician.

Second, there are risks for accidents in conjunction with the activities of removing the hood from the concealed overhead installation and manually performing a power-on reset, followed by the covering of the sensor unit S1 or pressing of a button. It is recalled that these activities will be performed at a considerable distance from the floor level FL; hence the technician may have to climb a chair or stepladder. The risk for fall accidents as well as accidents caused by dropping of parts from the concealed overhead installation, or tools, therefore cannot be neglected.

Third, it is recalled that the entrance system 1 is typically used in a public environment. Hence, the time of configuration should be as short as possible in order not to interfere with users wanting to enter or exit through the entrance system 1.

Accordingly, the present inventor has realized that there is room for improvements in this field.

SUMMARY

An object of the present invention is therefore to provide one or more improvements when it comes to configuration of entrance systems having a movable door member (or more than one movable door member), an automatic door operator for causing movement of the movable door member, and a sensor unit (or more than one sensor unit) for monitoring a zone near or at a door leaf of the door member for presence or activity of a person or object.

Accordingly, a first aspect of the present invention is an entrance system which comprises a movable door member having a door leaf with a first vertical edge and a second vertical edge. The entrance system also comprises an automatic door operator with a motor capable of causing movement of the door member, and a sensor unit mounted at or near the second vertical edge for monitoring a zone at or near the door leaf for presence or activity of a person or object. The sensor unit is designed for capturing an image of an external object at the first vertical edge of the door leaf, and processing the captured image to identify an optical code and recognize a learning mode trigger instruction encoded therein.

Triggered by the recognizing of the learning mode trigger instruction, the sensor unit is moreover designed for automatically entering into a learning mode of the sensor unit. In the learning mode, as entered when triggered by the recognizing of the learning mode trigger instruction, the sensor unit is designed for automatically measuring a distance between the sensor unit and the external object at the first vertical edge, and setting a field width parameter value of the sensor unit based on the measured distance.

The provision of such an entrance system will solve or at least mitigate one or more of the problems or drawbacks identified in the above, as will be clear from the following detailed description section and the drawings.

A second aspect of the present invention is configuration method for an entrance system having: a movable door member which has a door leaf with a first vertical edge and a second vertical edge, an automatic door operator comprising a motor capable of causing movement of the door member, and a sensor unit for monitoring a zone at or near the door leaf for presence or activity of a person or object.

The configuration method comprises the following:

Capturing an image of an external object at the first vertical edge of the door leaf Processing the captured image to identify an optical code and recognize a learning mode trigger instruction encoded therein.

Triggered by the recognizing of the learning mode trigger instruction, automatically entering into a learning mode of the sensor unit.

In the learning mode, as entered when triggered by the recognizing of the learning mode trigger instruction, automatically measuring a distance between the sensor unit and the external object at the first vertical edge, and setting a field width parameter value of the sensor unit based on the measured distance.

The provision of such a configuration method will solve or at least mitigate one or more of the problems or drawbacks identified in the above, as will be clear from the following detailed description section and the drawings.

In different embodiments, the movable door member may, for instance, be a swing door member, a revolving door member, a sliding door member, an overhead sectional door member, a horizontal folding door member or a pull-up (vertical lifting) door member. The entrance system may have just a single such door member, or two or more of them.

Embodiments of the invention are defined by the appended dependent claims and are further explained in the detailed description section as well as in the drawings.

It should be emphasized that the term "comprises/comprising" when used in this specification is taken to specify the presence of stated features, integers, steps, or components, but does not preclude the presence or addition of one or more other features, integers, steps, components, or groups thereof. All terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise. The steps of any method disclosed herein do not have to be performed in the exact order disclosed, unless explicitly stated.

A reference to an entity being "designed for" doing something in this document is intended to mean the same as the entity being "configured for", or "intentionally adapted for" doing this very something.

BRIEF DESCRIPTION OF THE DRAWINGS

Objects, features and advantages of embodiments of the invention will appear from the following detailed description, reference being made to the accompanying drawings.

DETAILED DESCRIPTION OF EMBODIMENTS

Figure 1:
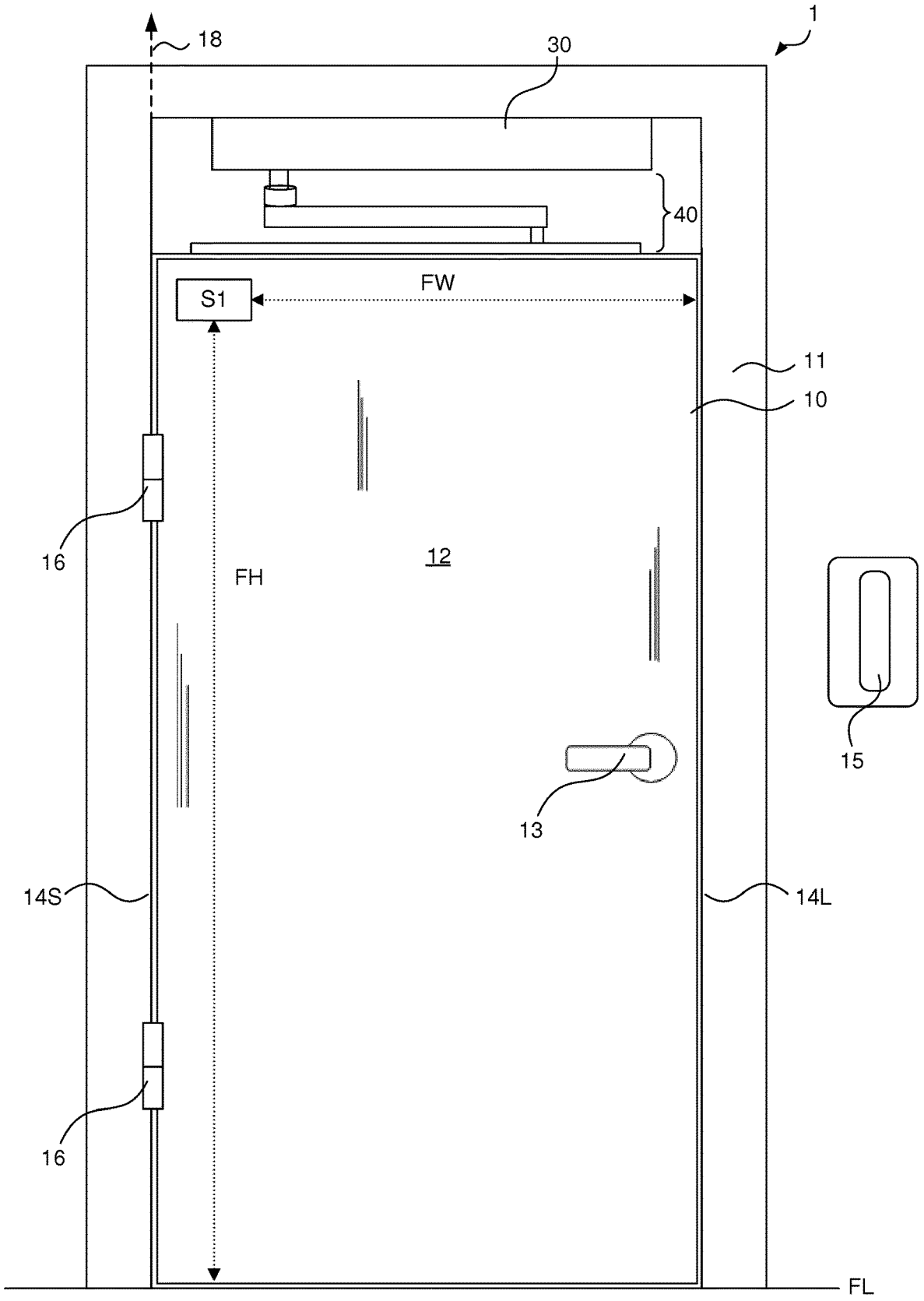
FIG. 1 is a schematic block diagram of an entrance system having a swing door, an automatic door operator and a sensor unit.

Embodiments of the invention will now be described with reference to the accompanying drawings. The invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the particular embodiments illustrated in the accompanying drawings is not intended to be limiting of the invention. In the drawings, like numbers refer to like elements.

Figure 2A:
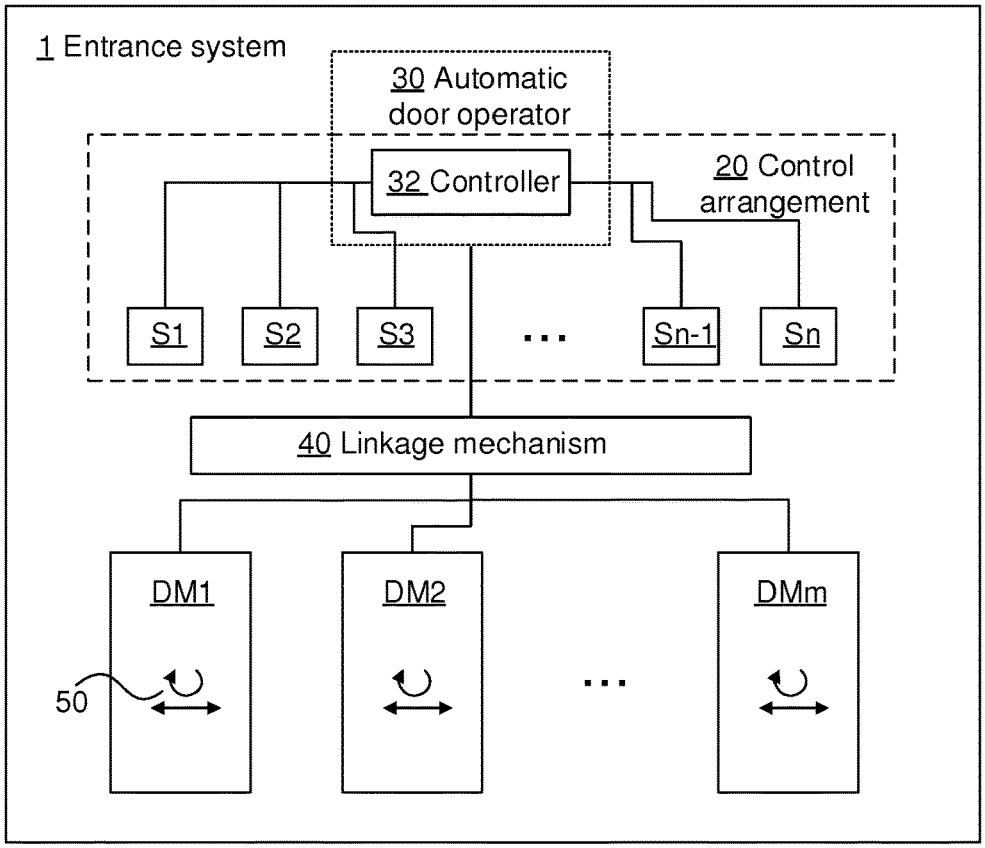
FIG. 2A is a schematic block diagram of an entrance system generally according to the present invention.

FIG. 2A is a schematic block diagram illustrating an entrance system 1 in which the inventive aspects of the present invention may be applied. The entrance system 1 comprises one or more movable door members DM1 . . . DMm, and an automatic door operator 30 for causing movements 50 of the door members DM1 . . . DMm between different positions, typically between closed and open end positions. The movements 50 may be rotational or translational. In FIG. 2A, a linkage mechanism 40 conveys mechanical power from the automatic door operator 30 to the movable door members DM1 . . . DMm.

Figure 2B:
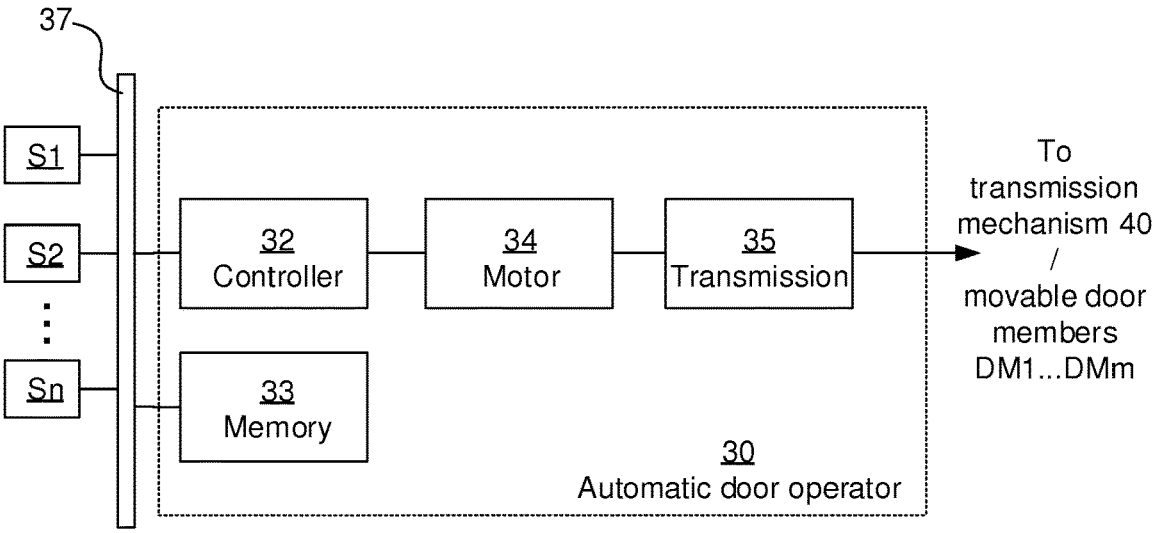
FIG. 2B is a schematic block diagram of an embodiment of an automatic door operator which may be included in the entrance system shown in FIG. 2A.

The entrance system 1 has a control arrangement 20 which comprises a controller 32. The controller 32 may be part of the automatic door operator 30, as can be seen in the embodiment of FIG. 2B to be described below. In other embodiments the controller 32 may be a separate device. The control arrangement 20 also comprises a number of sensor units S1 . . . Sn, where n≥1. Each sensor unit may generally be connected to the controller 32 by a wired connection, a wireless connection, or a combination thereof.

As will be exemplified in the subsequent description of the different embodiments in FIGS. 4A-D, 5 and 6, each sensor unit is arranged to monitor a respective zone Z1 . . . Zn at the entrance system 1 for presence or activity of a person or object. The person may be an individual who is present at the entrance system 1, is approaching it or is departing from it. The object may, for instance, be an animal or an article in the vicinity of the entrance system 1, for instance brought by the aforementioned individual. Alternatively, the object may be a vehicle or a robot.

FIG. 2B illustrates an embodiment of the automatic door operator 30 in more detail. As explained already in the Background section for the embodiment in FIG. 1, the automatic door operator 30 may typically be arranged as a concealed overhead installation in conjunction with a frame or other structure which supports the door members DM1 . . . DMm to move between different (e.g. closed and open) positions.

In addition to the aforementioned controller 32, the automatic door operator 30 comprises a motor 34, typically an electrical motor, being connected to an internal transmission or gearbox 35. An output shaft of the transmission or gearbox 35 rotates upon activation of the motor 34 and is connected to the external linkage mechanism 40. The external linkage mechanism 40 translates the motion of the output shaft of the transmission 35 into e.g. an opening or a closing motion 50 of one or more of the door members DM1 . . . DMm with respect to the frame or support structure.

The controller 32 is arranged for performing different functions of the automatic door operator 30, possibly in different operational states of the entrance system 1, using inter alia sensor input data from the sensor units S1 . . . Sn. Hence, the controller 32 is operatively connected with the sensor units S1 . . . Sn. At least some of the different functions performable by the controller 32 have the purpose of causing desired movements 50 of the door members DM1 . . . DMm. To this end, the controller 32 has at least one control output connected to the motor 34 for controlling the actuation thereof.

The controller 32 may be implemented in any known controller technology, including but not limited to microcontroller, processor (e.g. PLC, CPU, DSP), FPGA, ASIC or any other suitable digital and/or analog circuitry capable of performing the intended functionality.

The controller 32 also has an associated memory 33. The memory 33 may be implemented in any known memory technology, including but not limited to E(E)PROM, S(D)RAM or flash memory. In some embodiments, the memory 33 may be integrated with or internal to the controller 32. The memory 33 may store program instructions for execution by the controller 32, as well as temporary and permanent data used by the controller 32.

In the embodiment shown in FIG. 2B, the entrance system 1 has a communication bus 37. Some or all of the plurality of sensor units S1 . . . Sn are connected to the communication bus 37, and so is the controller 32 and the memory 33 of the automatic door operator 30. In other embodiments, other devices or components of the automatic door operator 30 may be connected to the communication bus 37. In still other embodiments, the outputs of the sensor units S1 . . . Sn may be directly connected to respective data inputs of the controller 32.

At least one of the sensor units S1 . . . Sn is a sensor unit for monitoring a zone (volume) at or near the door leaf of a movable door member for presence or activity of a person or object. In the forthcoming description, the first sensor unit S1 is exemplified as being such a sensor unit; the description may however be equally applicable also to the other sensor units S2 . . . Sn in different embodiments. The abilities of the first sensor unit S1 are used in a novel and inventive way pursuant to the invention for configuring the entrance system 1. An embodiment of the first sensor unit S1 is shown and described as sensor unit 300 in FIG. 3, and furthermore it may (but does not have to) be the same as the sensor unit S1 in the entrance system previously described for FIG. 1.

Figure 3:
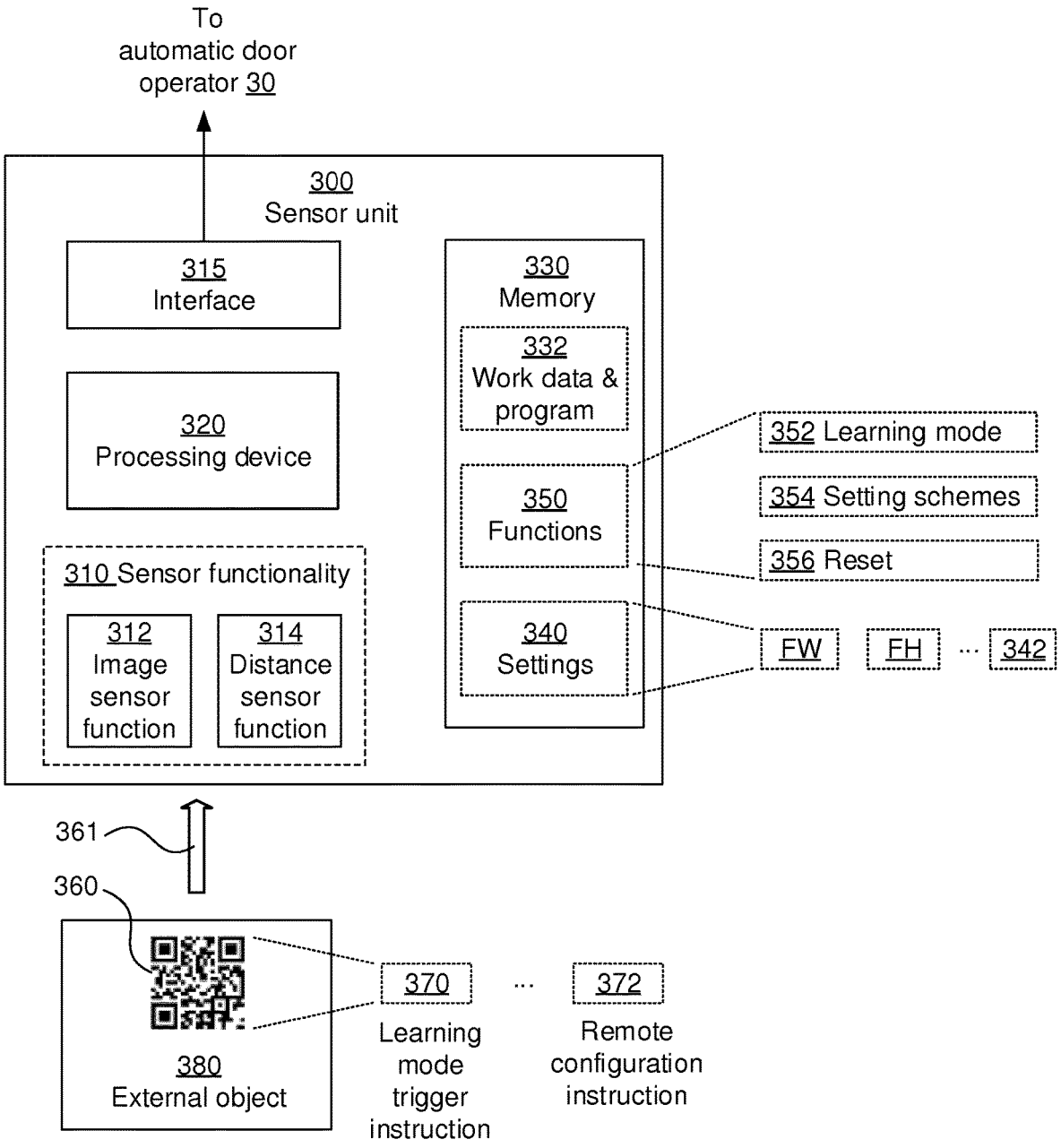
FIG. 3 is a schematic block diagram of a sensor unit generally according to the present invention. The sensor unit is arranged for capturing an image of an external object at a first vertical edge of a door leaf, processing the captured image to identify an optical code and recognize a learning mode trigger instruction encoded therein, and in response automatically entering into a learning mode of the sensor unit.

As seen in FIG. 3, the sensor unit 300 comprises sensor functionality 310 enabling the sensor unit 300 to monitor the zone at or near the door leaf of the movable door member for presence or activity of a person or object. The sensor functionality 310 includes an image sensor function 312 and a distance sensor function 314.

The image sensor function 312 is capable of capturing images of persons or objects appearing in or at the monitored zone. The image sensor function 312 may, for instance and without limitation, be a semiconductor charge-coupled device (CCD), an active pixel sensor in complementary metal-oxide-semiconductor (CMOS) technology, or an active pixel sensor in N-type metal-oxide-semiconductor (NMOS, Live MOS) technology.

The distance sensor function 314 is capable of measuring distances to persons or objects appearing in or at the monitored zone. The distance sensor function 314 may, for instance and without limitation, be implemented in any of the following sensor technologies: optical time-of-flight, active IR, optical triangulation, light curtain, stereoscopic camera, ultrasound echo, laser, and microwave radar.

In some embodiments, the image sensor function 312 and the distance sensor function 314 of the sensor functionality 310 may be implemented by the same physical device. Hence, the image sensor function 312 and the distance sensor function 314 are to be seen as two functions on a logical level but not necessarily on a physical level.

The sensor unit 300 also comprises a memory 330, and a processing device 320 operatively connected with the sensor functionality 310 and the memory 330. The processing device 320 may, for instance and without limitation, be implemented as a microcontroller, processor (e.g. PLC, CPU, DSP), FPGA, ASIC or any other suitable digital and/or analog circuitry capable of performing the intended functionality. The memory 330 may, for instance and without limitation, be implemented in any known memory technology, including but not limited to E(E)PROM, S(D)RAM or flash memory. In some embodiments, the memory 330, or part of it, may be integrated with or internal to the processing device 320 or the sensor functionality 310.

The memory 330 comprises work data and program code 332 which define the tasks of the sensor unit 300 when acting to monitor the zone (e.g. zone Z1 in FIG. 1) at or near the door leaf of the movable door member for presence or activity of a person or object, and to report detected presence or activity by a person or object in the monitored zone to the automatic door operator 30. To this end, the sensor unit 300 has an interface 315, for instance an interface for connecting to and communicating on the communication bus 37, or a direct electrical interface for connecting to a data input of the controller 32 of the automatic door operator 30, depending on implementation.

As previously explained, for operational reliability, the sensor unit 300 will need to be configured on site. Accordingly, the memory 330 is arranged for storing settings 340 for the sensor unit 300. As can be seen in FIG. 3, the settings 340 may include different values or parameters FW, FH, 342. Additionally, the memory 330 may be arranged for storing a plurality of functions 350, which may include a learning mode 352, one or more setting schemes 354, a reset function 356, etc.

Figure 7A:
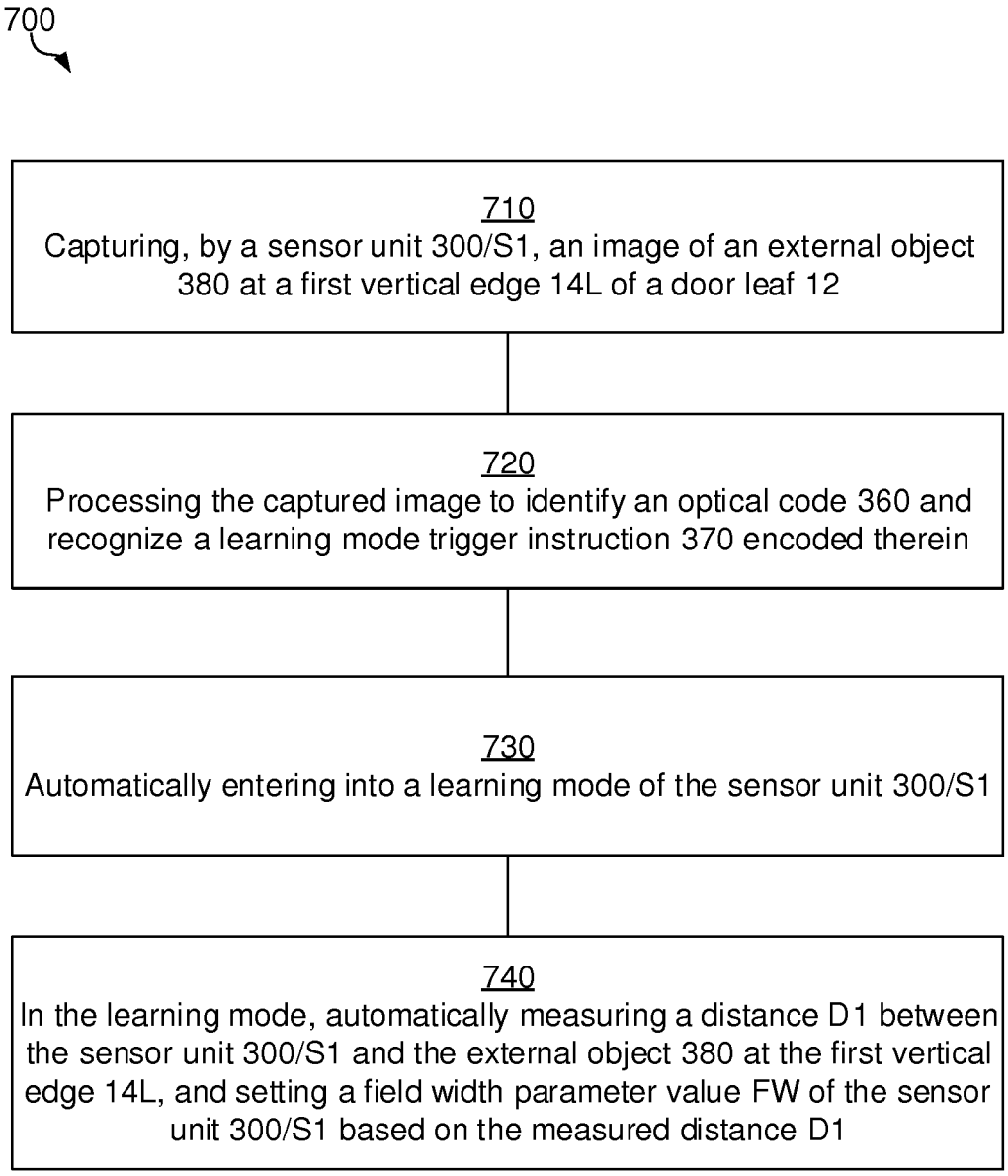
FIG. 7A is a flowchart diagram illustrating a configuration method for an entrance system generally according to the present invention.
Figure 7B:
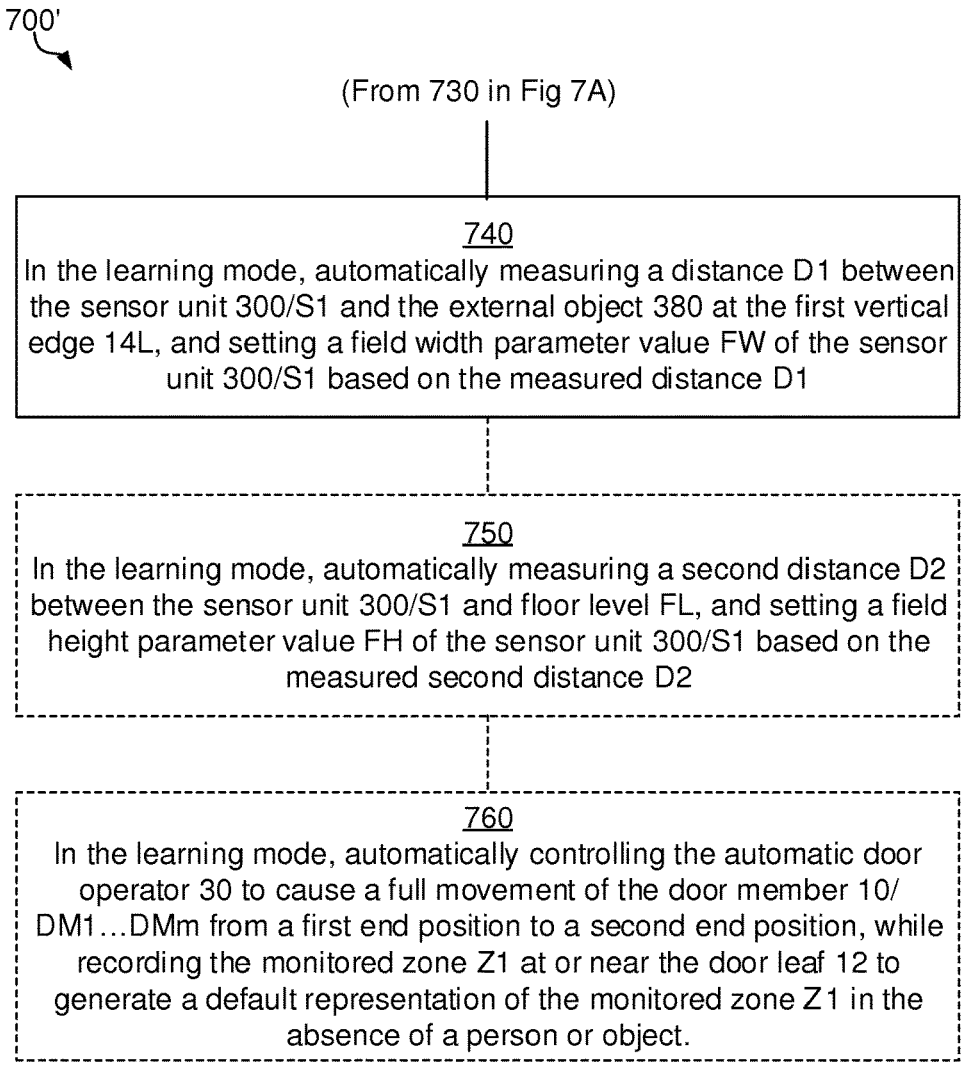
FIGS. 7B-7D are flowchart diagrams illustrating a configuration method according to some embodiments of the present invention.

A novel and inventive configuration method for the entrance system 1 is made possible thanks to the invention according to the following. This configuration method involves the sensor unit 300 in FIG. 3 and is outlined as seen at 700 in FIG. 7A, and accordingly FIG. 7 will be referred to below in parallel to FIG. 3 in the following description. Also, exemplifying reference will be made to FIGS. 4A-D, in which sensor unit 300 is embodied as sensor unit S1.

Figure 4A:
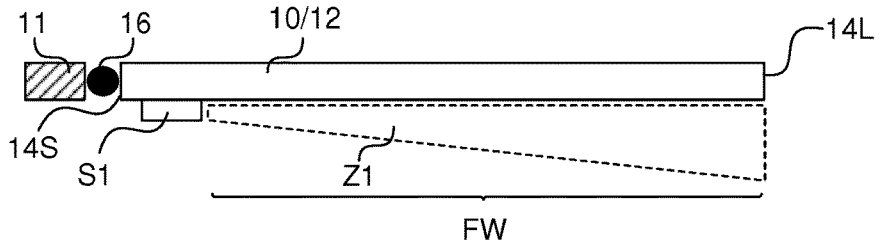
FIGS. 4A-4D illustrates different steps of a way of configuring an entrance system generally according to the invention.

Starting with FIG. 4A, the sensor unit S1 is shown in its operational position on the door leaf 12 of a door member 10, being mounted at or near the second vertical edge 14S of the door leaf 12. As already discussed, the sensor unit S1 will be monitoring a zone or volume Z1 at or near the door leaf 12 of the movable door member 10 for presence or activity of a person or object. The door member 10 may, for instance, be the swing door 10 in the entrance system 1 in FIG. 1.

Figure 4B:
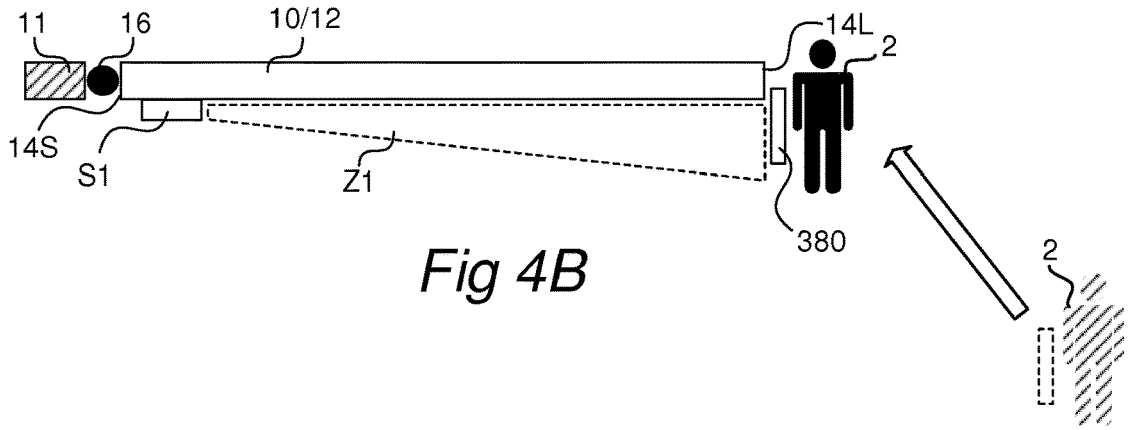
Figure 4C:
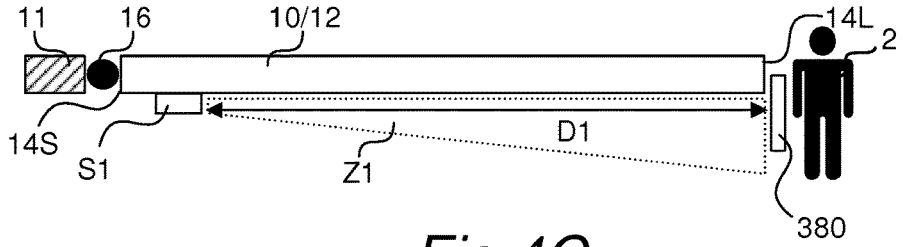
Figure 4D:
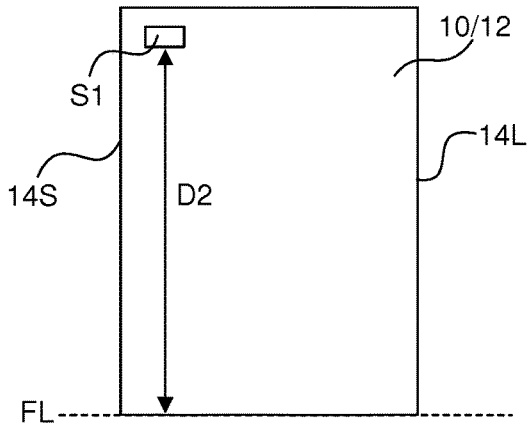

As is illustrated in FIG. 4B, a technician 2 (or other person) may bring an external object 380 to the first vertical edge 14L of the door leaf 12. The external object 380 is an object which carries or provides a machine-readable optical code 360, such as a piece of paper on which the optical code is printed, or a portable computing device having a display for presenting the machine-readable optical code 360.

In some embodiments, the machine-readable optical code 360 is a two-dimensional barcode. More specifically, as is the case in the disclosed embodiments, the machine-readable optical code 360 is a QR (Quick Response) code. In other embodiments, the machine-readable optical code 360 may be a one-dimensional barcode, such as a UPC (Universal Product Code) or EAN (European Article Number/International Article Number) code. Other alternatives may also exist, as would be clear to the skilled person. For instance, the optical code 360 may be a machine-readable three-dimensional barcode. Such a three-dimensional barcode may, for instance, be provided by means of a 3D printer to produce a code structure in three physical (spatial) dimensions. Alternatively, a machine-readable three-dimensional barcode may be provided as a two-dimensional barcode having a third dimension in the form of, color or other additional machine-readable information. The invention is not limited to usage of any specific kind of machine-readable optical code exclusively.

Since the sensor unit 300/S1 is operational to monitor the zone Z1, images of the zone Z1 and its surroundings will be captured on a regular basis. Accordingly, the sensor unit 300/S1 is designed for capturing an image of the external object 380 appearing at the first vertical edge 14L of the door leaf 12 (see, for instance, FIGS. 1 and 4B). This corresponds to step 710 in FIG. 7A and will be done by the image sensor function 312 of the sensor functionality 310 in the sensor unit 300/S1.

The sensor unit 300/S1 is moreover designed for processing the captured image to identify the optical code 360, and to recognize a learning mode trigger instruction 370 encoded in the optical code 360. This corresponds to step 720 in FIG. 7A and will be handled by the processing device 320 in the sensor unit 300/S1.

Triggered by the recognizing of the learning mode trigger instruction 370, the sensor unit 300/S1 is designed for automatically entering into the learning mode 352 of the sensor unit 300. This corresponds to step 730 in FIG. 7A and will be handled by the processing device 320 in the sensor unit 300/S1. The processing device 320 will read and execute, or otherwise invoke, the learning mode function 352 which is stored in the memory 330.

In the learning mode 352, which was entered when triggered by the recognizing of the learning mode trigger instruction 370, the sensor unit 300/S1 is designed for automatically measuring a distance D1 between the sensor unit 300/S1 and the external object 380 at the first vertical edge 14L of the door leaf 12. This can be seen in FIG. 4C and will be done by the distance sensor function 314 of the sensor functionality 310 in the sensor unit 300/S1.

The sensor unit 300/S1 is designed for setting a field width parameter value FW of the sensor unit 300/S1 based on the measured distance D1. This will be handled by the processing device 320 in the sensor unit 300/S1. The processing device 320 will set the field width parameter value FW in the settings 340 which are stored in the memory 330. This functionality corresponds to step 740 in FIG. 7A.

Hence, a way of configuring an entrance system has been achieved, which requires substantially less manual labour than in the prior art. The only manual intervention required is for the technician to bring the external object 380 with the machine-readable optical code 360 to the first vertical edge 14L of the door leaf 12. The rest of the configuration activities will follow automatically, triggered by the recognition by the sensor unit 300/S1 of the learning mode trigger instruction 370 in the optical code 360; no further manual intervention is required.

Accordingly, the risk of accidents in conjunction with the configuration will be substantially reduced, since no activities of removing a hood from a concealed overhead installation and manually performing a power-on reset, followed by the covering of the sensor unit S1 or pressing of a button, will be required.

Also, the time of configuration will be substantially reduced, for the benefit of users wanting to enter or exit through the entrance system 1.

In an advantageous embodiment, the sensor unit 300/S1 is further designed for the following. In the learning mode 352, as entered when triggered by the recognizing of the learning mode trigger instruction 370, the sensor unit 300/S1 will automatically measure a second distance D2 between the sensor unit 300/S1 and floor level FL. This can be seen in FIG. 4D and will be done by the distance sensor function 314 of the sensor functionality 310 in the sensor unit 300/S1.

The sensor unit 300/S1 is designed for setting a field height parameter value FH of the sensor unit 300/S1 based on the measured second distance D2. This will be handled by the processing device 320 in the sensor unit 300/S1. The processing device 320 will set the field height parameter value FH in the settings 340 which are stored in the memory 330. This functionality corresponds to step 750 in FIG. 7B, being optional but advantageous.

In this or another advantageous embodiment, the sensor unit 300/S1 is further designed for the following. In the learning mode 352, as entered when triggered by the recognizing of the learning mode trigger instruction 370, the sensor unit 300/S1 will automatically control the automatic door operator 30 to cause a full movement of the door member 10/DM1 . . . DMm from a first end position (such as a closed position) to a second end position (such as an open position), and back to the first end position (e.g. the closed position) if applicable.

While doing this, the sensor unit 300/S1 will record the monitored zone Z1 at or near the door leaf 12 to generate a default representation of the monitored zone Z1 in the absence of a person or object. This will be handled by the processing device 320 together with the sensor functionality 310 in the sensor unit 300/S1. This functionality corresponds to step 760 in FIG. 7B, being optional but advantageous.

One or more alternative embodiments are particularly beneficial for an entrance system which comprises one or more other sensor units S2 . . . Sn in addition to the sensor unit 300/S1. The sensor unit 300/S1 is designed for processing the captured image to derive a remote configuration instruction 372 encoded in the optical code 360, wherein the remote configuration instruction 372 pertains to configuration of at least one of the other sensor units S2 . . . Sn. The sensor unit 300/S1 is further designed for enabling execution of the derived remote configuration instruction 372 by the at least one of the other sensor units S2 . . . Sn. This functionality is illustrated in steps 770 and 775 of FIG. 7C, being optional but advantageous.

In another alternative embodiment, the sensor unit 300/S1 is designed for processing the captured image to derive a remote configuration instruction 372 encoded in the optical code 360, wherein the remote configuration instruction 372 pertains to configuration of the automatic door operator 30. The sensor unit 300/S1 is further designed for enabling execution of the derived remote configuration instruction 372 by the automatic door operator 30. This functionality is illustrated in steps 780 and 785 of FIG. 7D, being optional but advantageous.

Figure 7C:
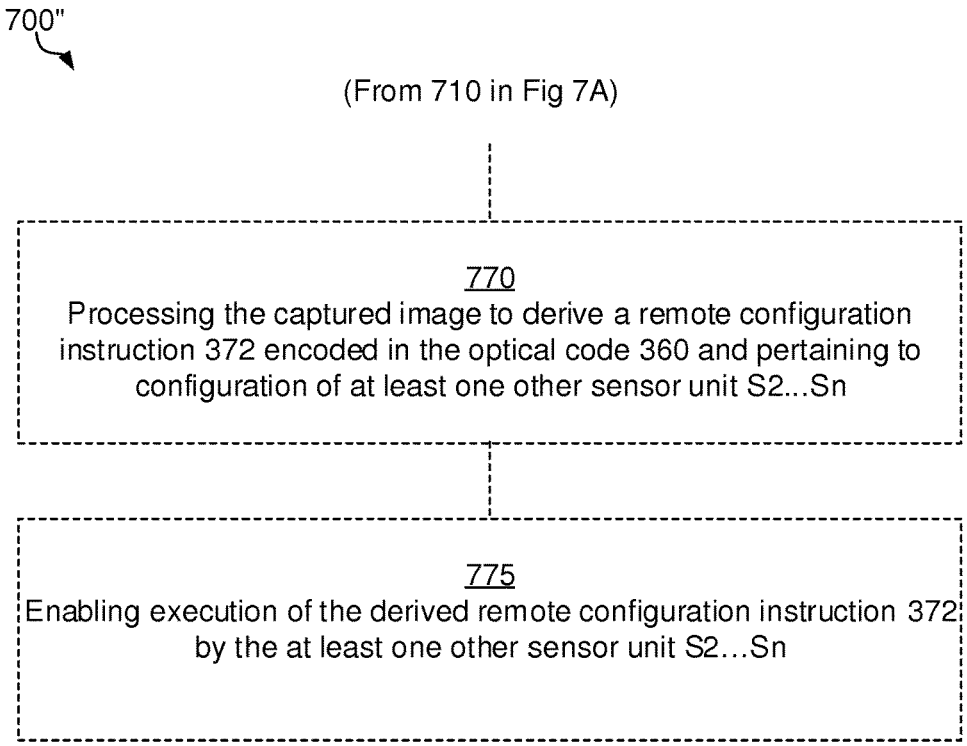
Figure 7D:
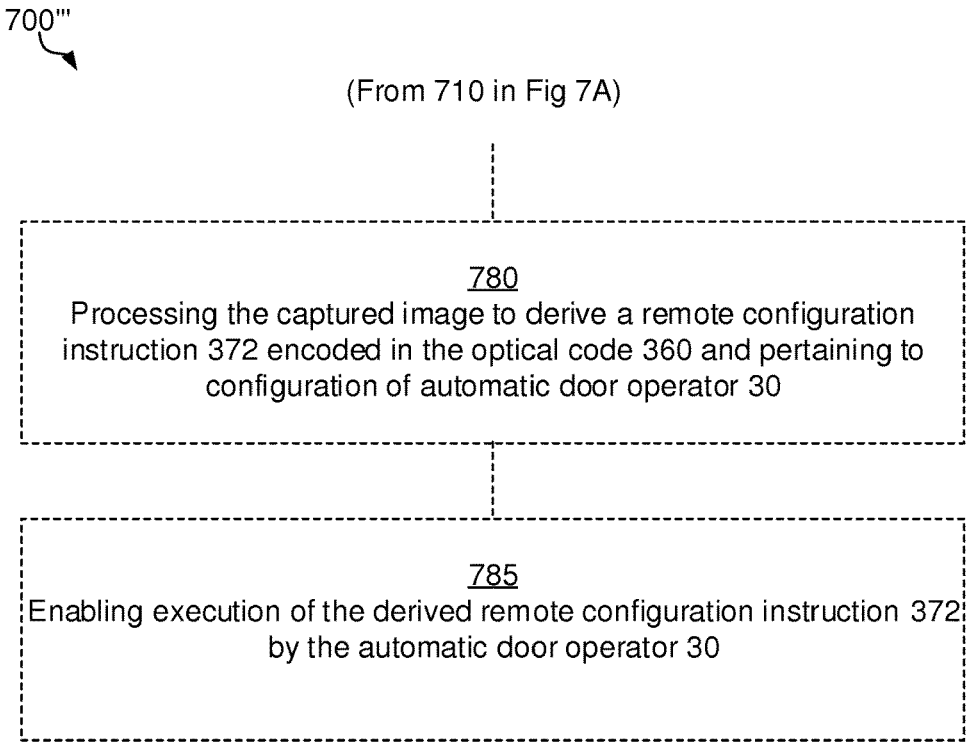

In the alternative embodiments of FIGS. 7C and 7D, the processing device 320 of the sensor unit 300/S1 may advantageously be arranged for executing the remote configuration instruction 372 by transmitting the derived remote configuration instruction in a broadcast message on the communication bus 37. The broadcast message will thus be receivable by any device connected to the communication bus 37, including the other sensor units S2 . . . Sn and the automatic door operator 30. Each receiving device may then decide whether the broadcasted remote configuration instruction applies to it, and if so execute the remote configuration instruction.

Alternatively, the processing device 320 of the sensor unit 300 may be arranged for executing the derived remote configuration instruction 372 by identifying a recipient device indicated by the remote configuration instruction 372, wherein the recipient device is the aforementioned at least one of the other sensor units S2 . . . Sn or the automatic door operator 30, and then transmitting the derived remote configuration instruction 372 in a message on the communication bus 37. In this case the message will hence be addressed to the recipient device specifically.

It is to be noticed that all these alternative embodiments will allow extended automatic configurability of the entrance system 1 without any further manual intervention by the technician 2.

Two further exemplifying embodiments of the entrance system 1 will now be described with reference to FIGS. 5 and 6.

Figure 5:
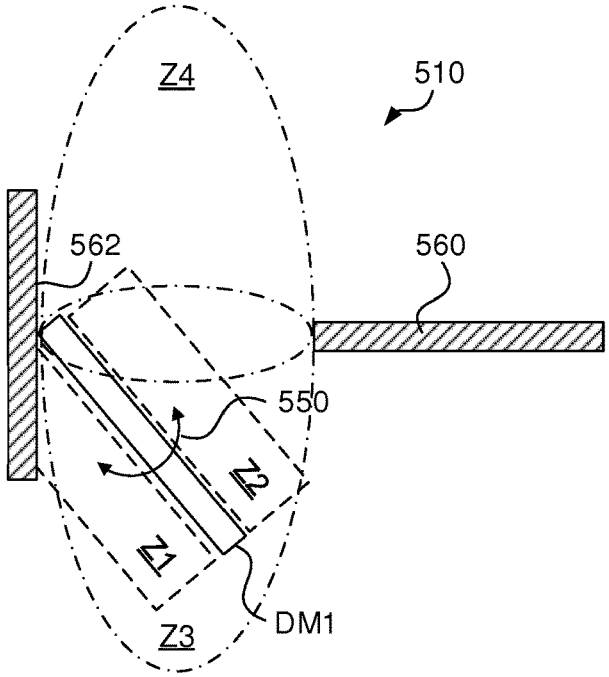
FIG. 5 is a schematic top view of an entrance system according to one exemplifying embodiment, in the form of a swing door system.

An embodiment of an entrance system in the form of a swing door system 510 is shown in a schematic top view in FIG. 5. The swing door system 510 comprises a single swing door DM1 being located between a lateral edge of a first wall 560 and an inner surface of a second wall 562 which is perpendicular to the first wall 560. The swing door DM1 is supported for pivotal movement 550 around pivot points on or near the inner surface of the second wall 562. The first and second walls 560 and 562 are spaced apart; in between them an opening is formed which the swing door DM1 either blocks (when the swing door is in closed position), or makes accessible for passage (when the swing door is in open position). An automatic door operator (not seen in FIG. 5 but referred to as 30 in the preceding figures and description) causes the movement 550 of the swing door DM1.

The swing door system 510 comprises a plurality of sensor units, each monitoring a respective zone Z1-Z4. The sensor units themselves are not shown in FIG. 5, but they are generally mounted at or near ceiling level and/or at positions which allow them to monitor their respective zones Z1-Z4. Again, each sensor unit will be referred to as Sx in the following, where x is the same number as in the zone Zx it monitors (Sx=S1-S4, Zx=Z1-Z4).

A first sensor unit S1 is mounted at a first central positon in FIG. 5 to monitor zone Z1. The first sensor unit S1 is a door presence sensor, and the purpose is to detect when a person or object occupies a space near a first side of the (door leaf of the) swing door DM1 when the swing door DM1 is being moved towards the open position during an opening state of the swing door system 510. The provision of the door presence sensor S1 will help avoiding a risk that the person or object will be hit by the first side of the swing door DM1 and/or be jammed between the first side of the swing door DM1 and the second wall 562; a sensor detection in this situation will trigger abort and preferably reversal of the ongoing opening movement of the swing door D1.

A second sensor unit S2 is mounted at a second central positon in FIG. 5 to monitor zone Z2. The second sensor unit S2 is a door presence sensor, just like the first sensor S1, and has the corresponding purpose i.e. to detect when a person or object occupies a space near a second side of the swing door DM1 (the opposite side of the door leaf of the swing door DM1) when the swing door DM1 is being moved towards the closed position during a closing state of the swing door system 510. Hence, the provision of the door presence sensor S2 will help avoiding a risk that the person or object will be hit by the second side of the swing door DM1 and/or be jammed between the second side of the swing door D1 and the first wall 560; a sensor detection in this situation will trigger abort and preferably reversal of the ongoing closing movement of the swing door DM1.

Advantageously, at least one of the door presence sensors S1 and S2 is an sensor unit which may be configured as described herein (thus implementing the sensor unit 300 according to the description above). Otherwise, they may for instance be active IR (infrared) sensors.

A third sensor unit S3 is mounted at an inner central positon in FIG. 5 to monitor zone Z3. The third sensor unit S3 is an inner activity sensor, and the purpose is to detect when a person or object approaches the swing door system 510 from the inside of the premises. The provision of the inner activity sensor S3 will trigger the sliding door system 510, when being in a closed state or a closing state, to automatically switch to an opening state for opening the swing door DM1, and then make another switch to an open state when the swing door DM1 has reached its fully open position.

A fourth sensor unit S4 is mounted at an outer central positon in FIG. 5 to monitor zone Z4. The fourth sensor unit S4 is an outer activity sensor, and the purpose is to detect when a person or object approaches the swing door system 510 from the outside of the premises. Similar to the inner activity sensor S3, the provision of the outer activity sensor S4 will trigger the swing door system 510, when being in its closed state or its closing state, to automatically switch to the opening state for opening the swing door DM1, and then make another switch to an open state when the swing door DM1 has reached its fully open position.

The inner activity sensor S3 and the outer activity sensor S4 may for instance be radar (microwave) sensors; however one or both of them may alternatively be a sensor unit as previously described herein (thus implementing the sensor unit 300 according to the description above). Alternatively, they may be configured by way of a remote configuration instruction as described herein.

Figure 6:
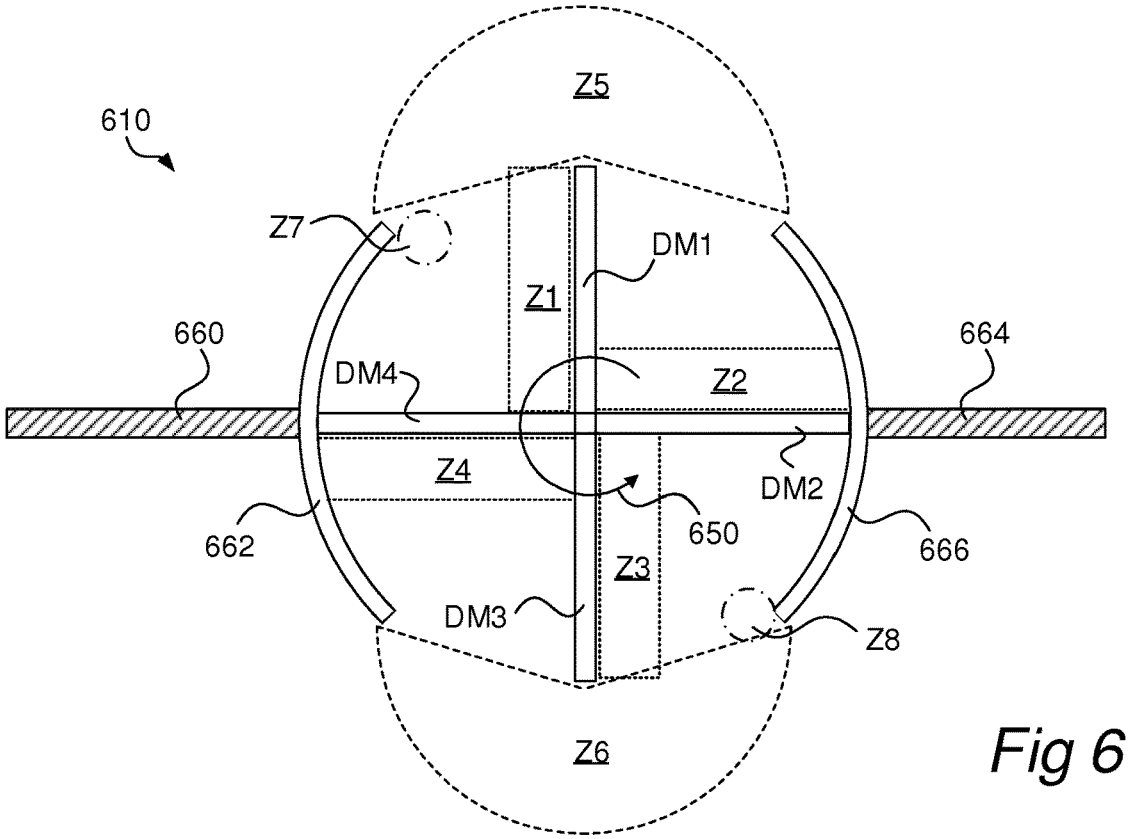
FIG. 6 is a schematic top view of an entrance system according to another exemplifying embodiment, in the form of a revolving door system.

An embodiment of an entrance system in the form of a revolving door system 610 is shown in a schematic top view in FIG. 6. The revolving door system 610 comprises a plurality of revolving doors or wings DM1-DM4 being located in a cross configuration in an essentially cylindrical space between first and second curved wall portions 662 and 666 which, in turn, are spaced apart and located between third and fourth wall portions 660 and 664. The revolving doors DM1-DM4 are supported for rotational movement 650 in the cylindrical space between the first and second curved wall portions 662 and 666. During the rotation of the revolving doors DM1-DM4, they will alternatingly prevent and allow passage through the cylindrical space. An automatic door operator (not seen in FIG. 6 but referred to as 30 in FIGS. 1 and 2) causes the rotational movement 650 of the revolving doors DM1-DM4.

The revolving door system 610 comprises a plurality of sensor units, each monitoring a respective zone Z1-Z8. The sensor units themselves are not shown in FIG. 6, but they are generally mounted at or near ceiling level and/or at positions which allow them to monitor their respective zones Z1-Z8. Again, each sensor unit will be referred to as Sx in the following, where x is the same number as in the zone Zx it monitors (Sx=S1-S8, Zx=Z1-Z8).

First to fourth sensor units S1-S4 are mounted at respective first to fourth central positons in FIG. 6 to monitor zones Z1-Z4. The first to fourth sensor units S1-S4 are door presence sensors, and the purpose is to detect when a person or object occupies a respective space (sub-zone of Z1-Z4) near one side of the (door leaf of the) respective revolving door DM1-DM4 as it is being rotationally moved during a rotation state or start rotation state of the revolving door system 610. The provision of the door presence sensors S1-S4 will help avoiding a risk that the person or object will be hit by the approaching side of the respective revolving door DM1-DM4 and/or be jammed between the approaching side of the respective revolving door DM1-DM4 and end portions of the first or second curved wall portions 662 and 666. When any of the door presence sensors S1-S4 detects such a situation, it will trigger abort and possibly reversal of the ongoing rotational movement 650 of the revolving doors DM1-DM4.

Advantageously, at least one of the door presence sensors S1-S4 is an sensor unit which may be configured as described herein (thus implementing the sensor unit 300 according to the description above). Otherwise, they may for instance be active IR (infrared) sensors.

A fifth sensor unit S5 is mounted at an inner non-central positon in FIG. 6 to monitor zone Z5. The fifth sensor unit S5 is an inner activity sensor, and the purpose is to detect when a person or object approaches the revolving door system 610 from the inside of the premises. The provision of the inner activity sensor S5 will trigger the revolving door system 610, when being in a no rotation state or an end rotation state, to automatically switch to a start rotation state to begin rotating the revolving doors DM1-DM4, and then make another switch to a rotation state when the revolving doors DM1-DM4 have reached full rotational speed.

A sixth sensor unit S6 is mounted at an outer non-central positon in FIG. 6 to monitor zone Z6. The sixth sensor unit S6 is an outer activity sensor, and the purpose is to detect when a person or object approaches the revolving door system 610 from the outside of the premises. Similar to the inner activity sensor S5, the provision of the outer activity sensor S6 will trigger the revolving door system 610, when being in its no rotation state or end rotation state, to automatically switch to the start rotation state to begin rotating the revolving doors DM1-DM4, and then make another switch to the rotation state when the revolving doors DM1-DM4 have reached full rotational speed.

The inner activity sensor S5 and the outer activity sensor S6 may for instance be radar (microwave) sensors and may advantageously be configured by way of a remote configuration instruction as described herein.

Seventh and eighth sensor units S7 and S8 are mounted near the ends of the first or second curved wall portions 662 and 666 to monitor zones Z7 and Z8. The seventh and eighth sensor units S7 and S8 are vertical presence sensors. The provision of these sensor units S7 and S8 will help avoiding a risk that the person or object will be jammed between the approaching side of the respective revolving door DM1-DM4 and an end portion of the first or second curved wall portions 662 and 666 during the start rotation state and the rotation state of the revolving door system 610. When any of the vertical presence sensors S7-S8 detects such a situation, it will trigger abort and possibly reversal of the ongoing rotational movement 650 of the revolving doors DM1-DM4.

The vertical presence sensors S7-S8 may for instance be active IR (infrared) sensors and may advantageously be configured by way of a remote configuration instruction as described herein.

The invention has been described above in detail with reference to embodiments thereof. However, as is readily understood by those skilled in the art, other embodiments are equally possible within the scope of the present invention, as defined by the appended claims. It is recalled that the invention may generally be applied in or to an entrance system having one or more movable door member not limited to any specific type. The or each such door member may, for instance, be a swing door member, a revolving door member, a sliding door member, an overhead sectional door member, a horizontal folding door member or a pull-up (vertical lifting) door member.

The invention claimed is:

1. An entrance system comprising:

a movable door member having a door leaf with a first vertical edge and a second vertical edge;

an automatic door operator comprising a motor configured to cause movement of the door member; and a sensor unit mounted at or near the second vertical edge for monitoring a zone at or near the door leaf for presence or activity of a person or object, the sensor unit being designed for:

capturing an image of an external object at the first vertical edge of the door leaf;

processing the captured image to identify an optical code and recognize a learning mode trigger instruction encoded therein;

triggered by the recognizing of the learning mode trigger instruction, automatically entering into a learning mode of the sensor unit; and in the learning mode, as entered upon being triggered by the recognizing of the learning mode trigger instruction, automatically measuring a distance between the sensor unit and the external object at the first vertical edge, and setting a field width parameter value of the sensor unit based on the measured distance.

2. The entrance system as defined in claim 1, wherein the sensor unit is further designed for:

in the learning mode, as entered upon being triggered by the recognizing of the learning mode trigger instruction, automatically measuring a second distance between the sensor unit and floor level, and setting a field height parameter value of the sensor unit based on the measured second distance.

3. The entrance system as defined in claim 1, wherein the sensor unit is further designed for:

in the learning mode, as entered upon being triggered by the recognizing of the learning mode trigger instruction, automatically controlling the automatic door operator to cause a full movement of the door member from a first end position to a second end position, while recording the monitored zone at or near the door leaf to generate a default representation of the monitored zone in an absence of a person or object.

4. The entrance system as defined in claim 1, further comprising one or more other sensor units in addition to said sensor unit, wherein said sensor unit is further designed for:

processing the captured image to derive a remote configuration instruction encoded in the optical code and pertaining to a configuration of at least one of said one or more other sensor units; and enabling execution of the derived remote configuration instruction by said at least one of said one or more other sensor units.

5. The entrance system as defined in claim 4, wherein the entrance system further comprises a communication bus, wherein said sensor unit, said one or more other sensor units and said automatic door operator are connected to the communication bus, wherein the sensor unit is arranged for enabling execution of the derived remote configuration instruction by transmitting the derived remote configuration instruction in a broadcast message on the communication bus, the broadcast message being receivable by any device connected to the communication bus.

6. The entrance system as defined in claim 4, wherein the entrance system further comprises a communication bus, wherein said sensor unit, said one or more other sensor units and said automatic door operator are connected to the communication bus, wherein the sensor unit is arranged for enabling execution of the derived remote configuration instruction by identifying a recipient device indicated by the remote configuration instruction, the recipient device being one of said one or more other sensor units or said automatic door operator; and transmitting the derived remote configuration instruction in a message on the communication bus and addressed to the recipient device.

7. The entrance system as defined in claim 1, wherein said sensor unit is further designed for:

processing the captured image to derive a remote configuration instruction encoded in the optical code and pertaining to a configuration of the automatic door operator; and enabling execution of the derived remote configuration instruction by the automatic door operator.

8. The entrance system as defined in claim 1, wherein the optical code is a machine-readable two-dimensional barcode.

9. The entrance system as defined in claim 1, wherein the optical code is a machine-readable one-dimensional barcode.

10. The entrance system as defined in claim 1, wherein the optical code is a machine-readable three-dimensional barcode.

11. The entrance system as defined in claim 1, wherein the sensor unit comprises sensor functionality for monitoring the zone at or near the door leaf, the sensor functionality comprising:

an image sensor function for capturing the image of the external object at the first vertical edge of the door leaf; and a distance sensor function for automatically measuring the distance between the sensor unit and the external object at the first vertical edge.

12. The entrance system as defined in claim 11, wherein the distance sensor function is implemented in any of the following sensor technologies:

optical time-of-flight;

active IR;

optical triangulation;

light curtain;

stereoscopic camera;

ultrasound echo;

laser; and microwave radar.

13. A configuration method for an entrance system having: a door movable member comprising a door leaf with a first vertical edge and a second vertical edge, an automatic door operator comprising a motor configured to cause movement of the door member, and a sensor unit mounted at or near the second vertical edge for monitoring a zone at or near the door leaf for presence or activity of a person or object, the configuration method comprising:

capturing an image of an external object at the first vertical edge of the door leaf;

processing the captured image to identify an optical code and recognize a learning mode trigger instruction encoded therein;

triggered by the recognizing of the learning mode trigger instruction, automatically entering into a learning mode of the sensor unit; and in the learning mode, as entered upon being triggered by the recognizing of the learning mode trigger instruction, automatically measuring a distance between the sensor unit and the external object at the first vertical edge, and setting a field width parameter value of the sensor unit based on the measured distance.

14. The configuration method as defined in claim 13, further comprising, in the learning mode, as entered upon being triggered by the recognizing of the learning mode trigger instruction, automatically measuring a second distance between the sensor unit and floor level, and setting a field height parameter value of the sensor unit based on the measured second distance.

15. The configuration method as defined in claim 13, further comprising, in the learning mode, as entered upon being triggered by the recognizing of the learning mode trigger instruction, automatically controlling the automatic door operator to cause a full movement of the door member from a first end position to a second end position, while recording the monitored zone at or near the door leaf to generate a default representation of the monitored zone in the absence of a person or object.

16. The configuration method as defined in claim 13, further comprising:

processing the captured image to derive a remote configuration instruction encoded in the optical code and pertaining to a configuration of at least one of said one or more other sensor units; and enabling execution of the derived remote configuration instruction by said at least one of said one or more other sensor units.

17. The configuration method as defined in claim 13, further comprising:

processing the captured image to derive a remote configuration instruction encoded in the optical code and pertaining to a configuration of the automatic door operator; and enabling execution of the derived remote configuration instruction by the automatic door operator.

18. The entrance system as defined in claim 1, wherein the optical code is a QR (Quick Response) code.

19. The entrance system as defined in claim 1, wherein the optical code is a UPC (Universal Product Code).

20. The entrance system as defined in claim 1, wherein the optical code is a EAN (European Article Number/International Article Number) code.

* * * * *